United States Patent [19]

Helland et al.

[11] Patent Number: 4,752,559

[45] Date of Patent: Jun. 21, 1988

[54] PRIMER/ANTIHALATION COATING FOR PHOTOTHERMOGRAPHIC CONSTRUCTIONS

[75] Inventors: Randall H. Helland, Maplewood, Minn.; Gregory J. McCarney, Hudson, Wis.

[73] Assignee: Minnesota Mining & Manufacturing Co., St. Paul, Minn.

[21] Appl. No.: 30,038

[22] Filed: Mar. 24, 1987

[51] Int. Cl.[4] ..... G03C 1/84

[52] U.S. Cl. ..... 430/510; 430/514; 430/516; 430/523; 430/536; 430/538; 430/617; 430/619

[58] Field of Search ..... 430/518, 514, 516, 523, 430/536, 538, 617, 619

[56] References Cited

U.S. PATENT DOCUMENTS

| | | | |
|---|---|---|---|
| 3,392,021 | 7/1968 | McGuckin | 430/510 |
| 3,457,075 | 7/1969 | Morgan et al. | 96/67 |
| 3,650,753 | 3/1972 | Bacon | 430/510 |
| 3,839,049 | 10/1974 | Simons | 96/114.6 |
| 4,301,239 | 11/1981 | Miller | 430/510 |
| 4,376,162 | 3/1983 | Kawata et al. | 430/510 |
| 4,395,484 | 7/1983 | McCarney | 430/620 |
| 4,461,828 | 7/1984 | Metz et al. | 430/592 |
| 4,476,220 | 10/1984 | Penfound | 430/569 |
| 4,477,562 | 10/1984 | Zeller-Pendrey | 430/510 |

FOREIGN PATENT DOCUMENTS 1110046 4/1968 United Kingdom .

*Primary Examiner*—Jack P. Brammer

*Attorney, Agent, or Firm*—Donald M. Sell; James A. Smith; Lorraine R. Sherman

[57] ABSTRACT

A photothermographic recording article comprises in sequence:

(a) a substrate, (b) a prime coat/antihalation layer comprising a pigmented acrylic polymer binder system, (c) a photothermographic dispersion comprising a binder, a non-light sensitive silver source material, photographic silver halide in catalytic proximity to silver source material, and (d) optionally, a topcoat layer, said article further comprising a reducing agent for silver ion and at least one development accelerator in at least one of the layers of the substrate.

17 Claims, No Drawings

PRIMER/ANTIHALATION COATING FOR PHOTOTHERMOGRAPHIC CONSTRUCTIONS

FIELD OF THE INVENTION

The present invention relates to silver halide photothermographic constructions and in particular to a primer/antihalation coating therefor.

BACKGROUND ART

Silver halide photothermographic imaging materials, often referred to as 'dry silver' compositions because no liquid development is necessary to produce the final image, have been known in the art for many years. These imaging materials basically comprise a light insensitive, reducible silver source, a light sensitive material which generates silver when irradiated, and a reducing agent for the silver source. The light sensitive material is generally photographic silver halide which must be in catalytic proximity to the light insensitive silver source. Catalytic proximity is an intimate physical association of these two materials so that when silver specks or nuclei are generated by the irradiation or light exposure of the photographic silver halide, those nuclei are able to catalyze the reduction of the silver source by the reducing agent. It has been long understood that silver is a catalyst for the reduction of silver ions and the silver-generating light sensitive silver halide catalyst progenitor may be placed into catalytic proximity with the silver source in a number of different fashions, such as partial metathesis of the silver source with a halogen-containing source (e.g., U.S. Pat. No. 3,457,075), coprecipitation of the silver halide and silver source material (e g., U.S. Pat. No. 3,839,049), and any other method which intimately associates the silver halide and the silver source.

The silver source used in this area of technology is a material which contains silver ions. The earliest and still preferred source comprises silver salts of long chain carboxylic acids, usually of from 10 to 30 carbon atoms. The silver salt of behenic acid or mixtures of acids of like molecular weight have been primarily used. Salts of other organic acids or other organic materials such as silver imidazolates have been proposed, and British Pat. No. 1,110,046 discloses the use of complexes of inorganic or organic silver salts as image source materials.

In both photographic and photothermographic emulsions, exposure of the silver halide to light produces small clusters of silver atoms. The imagewise distribution of these clusters is known in the art as the latent image. This latent image generally is not visible by ordinary means and the light sensitive article must be further processed in order to produce a visual image. The visual image is produced by the catalytic reduction of silver which is in catalytic proximity to the specks of the latent image. Certain dyes can be used to spectrally sensitize photothermographic emulsions. This is accomplished by adding the dyes to the emulsion before, during, or after formation or addition of the silver halide component. See, for example, U.S. Pat. Nos. 4,461,828 and 4,476,220.

Antihalation layers are known in the photothermographic construction art. Their purpose can be to decrease light scattering by absorbance of incident and reflected light. Some antihalation agents (sometimes referred to as "acutance agents") improve image quality by reducing diffuse scattering of light from the substrate, the coated layers, or the various interfaces in a coated light-sensitive construction. Typically, they include ultraviolet light-absorbing coating surfaces, UV absorbing organic binders, and ultraviolet light-absorbing compounds and dyes, which are well known to those skilled in the art. Rutile titanium dioxide has been described as a useful antihalation agent, see for example U.S. Pat. No. 4,395,484.

Primer coatings of use in photothermographic construction typically include polyvinyl butyrals, ethyl cellulose, or polyvinyl alcohol.

SUMMARY OF THE INVENTION

Briefly, the present invention provides a photothermographic recording article comprising in sequence:

(a) a substrate, (b) a prime coat/antihalation layer comprising a pigmented acrylic polymer binder system, (c) a photothermographic dispersion layer comprising a binder, a non-light sensitive silver source material, photographic silver halide in catalytic proximity to said silver source material, and (d) optionally, a topcoat layer, said article further comprising a reducing agent for silver ion and at least one development accelerator in at least one of the layers on the substrate.

Prior to the present invention, the binder system in a primer layer was not thought to influence a dry silver construction other than as a vehicle to disperse the pigment and to provide adherence between the support and silver dispersion layer. Stability, aging, and adhesion tests have shown the instant acrylic binder system provides improved stability and aging characteristics compared to conventional binder systems. This is surprising because there is no discernible chemical structure that dictates why the acrylates are superior to other resins for dry silver stability and aging.

It has been found that a prime coat/antihalation layer added to a dry silver construction improves light scattering by the absorbance of incident and reflected light, this being accomplished by the use of a pigmented acrylic polymer binder system to improve sharpness. It is well known in the photographic arts that image sharpness is a function of refractive index of reflective substrates. A high refractive index pigment, such as titanium dioxide, improves image sharpness.

The instant invention provides a dry silver construction with improved adhesion, stability and shelf-life. In particular, it can provide a paper construction with an antihalation layer (a prime coat) to approach filled extruded film quality at a paper cost. In addition, use of the prime coat/antihalation layer in the construction of the present invention acts as a barrier layer and prevents penetration of the imaging media into the substrate when paper or other porous support is used.

In this application:

"prime coat" means a coating applied to a substrate, prior to the application of a photosensitive layer, to improve the performance of the bond, the optical properties, and to limit penetration of the photosensitive layer into the substrate (if paper); and "catalytic proximity" means in intimate contact, i.e., in reactive association, so that they can react with one another.

DETAILED DESCRIPTION

Photothermographic dispersions of the present invention are usually constructed as one or two layers on a substrate. Single layer constructions must contain the silver source material, the silver halide, the developer and binder as well as optional additional materials such as toners, coating aids and other adjuvants in the same layer. Two- or more layer constructions must contain the silver source and silver halide in one dispersion layer (usually the layer adjacent the primer layer). The other ingredients can be incorporated in the prime layer, the dispersion layer, the topcoat, or any combination thereof.

Coatings of the photothermographic layer compositions may be made on a temporary support and removed therefrom in dry thin film form, but will ordinarily be applied to a substrate, such as glass, transparent polymeric films, opaque polymeric films such as titanium dioxide pigmented polyester film, paper, fabric, and metal foils, which form part of the final sheet product. A preferred substrate of the present invention is a photographic paper, such as a uniformly calendered photographic paper base.

The photothermographic recording article of the present invention includes a prime coat/antihalation layer adjacent the support. The binder system of the prime coat/antihalation layer comprises at least one acrylic polymer or copolymer thereof or combinations thereof. Any acrylic polymer, copolymer, or combination thereof is useful in the present invention prime coat/antihalation layer so long as it is substantially insoluble in and inpenetrable by solvents of adjacent layer(s). Representative polyacrylates and polymethacrylates include esters of $C_1$ to $C_{20}$ alkyl alcohols, preferably esters of $C_1$ to $C_{14}$ alkyl alcohols. Preferred for solvent coating are polyacrylates and methacrylates of lower ($C_1$ to $C_4$) alkyl alcohols. Most preferred acrylate polymers are methyl methacrylate/ethyl acrylate copolymer (A-21 TM, B-82 TM, Rohm and Haas, Philadelphia, Pa.), methyl methacrylate polymer (A-11 TM, Rohm and Haas, Phildelphia, Pa.), methyl methacrylate/butyl methacrylate copolymer (B-66 TM, Rohm and Haas), and isobutyl methacrylate polymer (B-67 TM, Rohm and Haas). Control of light scattering can be enhanced by addition of pigment to the binder.

Representative examples of useful pigments to be included in the prime coat/antihalation layer include titanium dioxide, zinc oxide, barium sulfate, and calcium carbonate. Titanium dioxide pigments with the highest refractive indices are preferred in prime coatings. The ratio (weight percent) of pigment to binder in prime coatings is variable from 4:1 to 1:10, preferably 2:1 to 1:5, depending upon the applications and should tend to be closer to the 1:5 range with dry silver formulations. The lower range of titanium dioxide is preferred to minimize its photolytic properties.

Rutile titanium dioxide is a particularly useful antihalation component, and it is present in the prime coat/antihalation layer above the substrate in sufficient quantity to control light scatter. Useful amounts of titanium dioxide are, for example, 5 to 80, preferably 10 to 30 weight percent in a 25 micrometer (1 mil) thick resin coating on paper.

Titanium dioxide is routinely utilized in photographic RC (resin coated) papers for its properties of providing whiteness and high opacity to the resin coating. Also, it reduces light scattering from the coating surface, thus improving photographic sharpness. Titanium dioxide, when properly selected as to grade, surface treatment, and method of incorporation, is non-reactive with the other components of the present construction. For paper applications, titanium dioxide is preferably matrixed in a resin or plastic coating over the paper. The $TiO_2$-containing layer prevents the silver coating from penetrating into paper fibers.

The present invention utilization of acrylic polymers for the binder system in a prime coat/antihalation layer of a dry silver paper construction gives improved stability and shelf-life aging over the resin systems such as ethyl cellulose or poly vinyl butyrals. The standard prime coat with a polyvinyl butyral binder gives a density ($\Delta$Dmin) increase (from white to gray) of 0.10 to 0.12 MacBeth reflectance density units and with an acrylic binder system this change is on the average of 0.04 to 0.05 MacBeth reflectance density units when aged in a light box at 1000 foot candles of fluorescent lighting (daylight fluorescent tube) at 75% relative humidity and at ambient temperatures for 12 hours. This change in Dmin is noted because photothermographic systems of this type do not chemically 'fix' or remove silver halide salts after development. Also, as is shown in the examples below, acrylic resin binder prime layers produce distinctly superior sensitometric stability and post processing whiteness stability compared to other resin-containing prime layers.

The typical procedure in making a prime coat starts with the dissolving of a specified acrylic resin in a compatible organic solvent such as aliphatic or aromatic ketones, hydrocarbons, etc. A preferred solvent is methylethyl ketone. The pigment is then added and high shear mixed for 0.5 to 1 hour. The dispersion is homogenized at a pressure of $5.5\times10^7$ N/m$^2$ (8000 psi). A variation of this procedure would involve adding the pigment to the solvent first, allowing for more shear of the pigment agglomerates. Typically the total solids of the prime coat is governed by viscosity and orifice settings required to achieve specified coat weight during coating. Prime coat formulations for the dry silver systems comprise 10 to 100 weight percent solids. Solvent based coating formulations preferably comprise 10 to 80 weight percent solids, most preferably in the range of 15 to 30 weight percent solids. Radiation cured prime layer composition can comprise 100 weight percent solids.

The layer can be coated by any means known in the art, such as roll coating, curtain coating, extrusion coating, knife coating, spray coating, dip coating, radiation-cured coating, etc. Useful thicknesses of the wet dispersion is generally in the range of 25 to 250 micrometers (1 to 10 mils.)

The photosensitive (UV, visible, or IR) heat-developable layer contains any photosensitive silver halide such as silver bromide, silver iodide, silver chloride, silver bromoidide, silver chlorobromoidide, silver chlorobromide, etc., and may be added to the emulsion layer in any fashion which places it in catalytic proximity to the silver source. The silver halide is generally present as 0.05 to 5 percent by weight of the imaging layer, although larger amounts up to 10 weight percent can be useful. It is preferred to use from 0.1 to 2.0 percent by weight silver halide in the imaging layer and most preferred to use from 0.3 to 1.0 weight percent.

The reducing agent for silver ion may be any material, preferably organic material, which will reduce silver ion to metallic silver.

Reducing agents which are useful in the present invention include substituted and unsubstituted bisphenols, naphthols, aminophenols, sulfonamido-phenols, catechols, pyrogallols, di- or polyhydroxybenzenes, ascorbic acid, phenidone, metol, and hydroquinone ethers.

The reducing agent should be present as 1 to 10 percent by weight of the imaging layer. In a two-layer construction, if the reducing agent is in the second layer, slightly higher proportions, of from about 2 to 15 percent tend to be more desirable.

Reducing agents for silver ion of the hindered phenolic types are particularly useful for inclusion in the photosensitive layer because they exhibit good shelf stability, maintain a strong reduction differential in light struck vs. non-light struck areas, and are soluble in the solvents used. Suitable phenolic type reducing agents are present in an amount of 0.1 or higher, preferably in a range of 0.1 mole to 2.0 moles reducing agent per mole silver and includes:

2,2'-methylenebis-(4-methyl-6-tertiarybutyl phenol),
2,2'-methylenebis-(4-ethyl-6-tertiarybutyl phenol),
1,1-di(2,4-dimethyl phenol)-3-methyl-5,5-dimethylhexane, and
2,6-methylene-bis(2-hydroxy-3-tertiary-5-methylphenyl)-4-methylphenol.

Development accelerators, sometimes referred to as image 'toners', can be a component of any of the layers on the substrate of the instant photothermographic construction, i.e. in the prime coat/antihalation layer, the emulsion layer, or the topcoat. Development accelerators aid the relatively weak developing (reducing) agents to produce a dense black image at the thermal development conditions utilized. Various types of development accelerators are known in the art; a partial list includes: phthalazinone, see U.S. Pat. No. 3,080,254; imidazole and phthalic acid compounds, see U.S. Pat. No. 3,847,612; phthalimide, see Belgium Pat. No. 766,590; N-hydroxyphthalimide, see U.S. Pat. No. 3,782,941; substituted phthalazinone, U.S. Pat. No. 3,844,797; and phthalazine and a phthalic acid compound, see U.S. Pat. No. 4,123,282. Phthalazinone by itself, or phthalazine and 4-methylphthalic acid in combination are preferred development accelerators in the present invention. In the present invention, the development accelerator can be present in any layer, i.e. in the prime coat/antihalation layer, the photosensitive layer, but preferably it is present in a topcoat layer. These materials may be present, for example, in amounts of from 0.2 to 5 percent by weight.

The binder for the photosensitive layer may be selected from any of the well known natural and synthetic resins such as gelatin, polyvinyl acetals, polyvinyl chloride, polyvinyl acetate, cellulose, acetate, polyolefins, polyesters, polystyrene, polyacrylonitrile, polycarbonates, and the like. Copolymers and terpolymers are of course included in these definitions. The polyvinyl acetals, such as polyvinyl butyral and polyvinyl formal, and vinyl copolymers, such as polyvinyl acetate/chloride are particularly desirable. The binders are generally used in a range of from 20 to 75 percent by weight of each layer, and preferably about 30 to 55 percent by weight.

The construction of the present invention optionally includes a protective topcoat as is known in the art. This layer can include development accelerators, developers, reducing agent for silver, surfactant, antihalation dyes, optical brightness, UV absorbers, flatting agents, and the like as is known in the art.

Illumination sources for the construction of the present invention include special phosphor fluorescent tubes or cathode ray tube screens, xenon lamps, mercury vapor lamps, carbon arc lamps, ultraviolet output lasers, infrared lasers, visible output lasers, visible support diodes, infrared diodes, and the like.

In addition to the essential components described above, any of the coatings of the invention may contain additional components such as wetting agents, dispersing aids, antifoggants, flatting agents, light bleachable dyes for registration of where previous exposures have been made, adhesion promoting agents, tinting dyes, pigments, fillers, etc.

The various layers can be coated by any of the methods known in the art, including those mentioned above.

The present invention provides photothermographic imaging materials which exhibit image quality with a primer layer binder system which provides improved whiteness stability, product shelf life and/or adhesion. The imaging materials are useful in high resolution electro-optic applications, such as high resolution, facsimile, medical recording, CAD/CAM, and as graphic arts materials.

Objects and advantages of this invention are further illustrated by the following examples, but the particular materials and amounts thereof recited in these examples, as well as other conditions and details, should not be construed to unduly limit this invention.

EXAMPLE 1

Methyl methacrylate polymer 30 weight percent solids in tolune/butanol 9:1 (Acryloid A-21 TM, Rohm & Haas Co., Philadelphia, Pa.) and polyvinyl butyral (B-73 TM, Monsanto Co.) were used as the resin vehicles for titanium dioxide pigment dispersions. The priming coatings were knife coated at approximately 7.5 gms/m$^2$ over opaque polyester film. The use of polyester film as the substrate in all cases was designed to show the effect of the primary surface, since untreated polyester film is virtually inert toward photothermographic chemistry and thus serves as a useful control.

A red sensitive photothermographic formulation was coated on the white polyester film, on the methyl methacrylate (A-21)/$TiO_2$ primed polyester surface, and on the polyvinyl butyral (B-73)/$TiO_2$ primed polyester surface.

The samples were exposed to a millisecond flash exposure via a red filtered pulsed xenon sensitometer (EG & G Mark VI, Edgerton Germeshausen and Grier) and processed for four seconds at 131° C. on a roller type thermal processor. Results are shown below.

| Substrate | Dmin | Dmax | Gamma | Speed (ergs/cm$^2$ at 1.01) |
|---|---|---|---|---|
| White polyester | 0.15 | 1.69 | 2.71 | 4 ergs |
| A-21/$TiO_2$ prime on white polyester | 0.13 | 1.69 | 2.34 | 4 ergs |
| B-73/$TiO_2$ prime on white polyester | 0.09 | 1.21 | 1.43 | 7 ergs |

The sensitometry data revealed the loss in sensitivity, density and contrast with B-73 resin as compared to A-21 methyl methacrylate resin priming layer. The A-21 resin priming layer was slightly lower in contrast than the control unprimed polyester sheet, but by less that 3° of slope in the sensitometric curve.

The same samples were tested in a high intensity light chamber for 2 hours (test condition: daylight fluorescent tubes, 2000fc, approximately 60%RH, approximately 27° C. ambient air temperature.) The samples were measured for lightness and color coordinates (deviation from neutral white) before and after this exposure. The results are listed below:

| Substrate | Condition | L | a | b | ΔE |
|---|---|---|---|---|---|
| White polyester | Initial | 87.06 | −1.55 | 3.45 | |
| ($TiO_2$ filled | Final | 83.79 | −0.29 | 3.74 | |
| polyester) | Delta | −3.27 | 1.26 | 0.29 | 3.5 |
| A-21/$TiO_2$ Prime | Initial | 86.46 | −1.32 | 2.71 | |
| | Final | 82.26 | 0.06 | 3.27 | |
| | Delta | −4.20 | 1.38 | 0.56 | 4.5 |
| B-73/$TiO_2$ Prime | Initial | 92.18 | −1.46 | 3.83 | |
| | Final | 79.09 | 2.3 | 6.15 | |
| | Delta | −13.09 | 3.76 | 2.32 | 13.8 |

Where:

L=Hunter Lab spectrocolorimeter (Hunter Associates Laboratory, Inc. Reston, Va.) lightness value a=red/green color coordinate; red values are increasingly positive, green values are increasingly negative b=yellow/blue color coordinate; yellow values are increasingly positive, blue values are increasingly negative.

ΔE=square root of the sum of squares of the ΔL, Δa, and Δb values; lower values exhibit less change.

The whiteness stability test showed a very clear distinction in the stability of the A-21 versus the B-73 resin prime; the acrylic resin prime layer was only slightly less stable than the unprimed polyester base.

EXAMPLE 2

Rutile titanium dioxide was added to methyl methacrylate (A-21 resin, Rohm & Haas), polyvinyl butyral B-73, and polyvinyl butyral B-76 resins (Monsanto) at a 1:2 pigment to binder ratio. These dispersions were homogenized prior to coating on 51 micrometer (2 mil) thick white polyester, which is photoinert to photothermographic chemistry.

The colorimetry of the primed polyester was measured prior to coating with a Hunter Lab spectrocolorimeter. The results given below show that the initial optical characteristics of the primed substrates were very similar.

| Priming Resin | L | a | b | Opacity |
|---|---|---|---|---|
| B-73 | 95.47 | −0.79 | 2.81 | 91.9 |
| B-76 | 95.37 | −0.77 | 2.82 | 92.4 |
| A-21 | 95.25 | −0.81 | 2.95 | 92.5 |

The samples were coated with a blue green photothermographic formulation, which consisted of a light sensitive silver salt layer and a topcoat layer. Each sample was exposed at $10^{-6}$ seconds on a pulsed xenon sensitometer with a 0–4 stepless density wedge. The sensitometry is shown below (processed for four seconds at 131° C.):

| Priming Resin | Dmin | Dmax | Gamma | Speed (ergs/cm² at 1.4 density) |
|---|---|---|---|---|
| B-73 | 0.05 | 1.67 | 0.93 | 103 |
| B-76 | 0.09 | 1.72 | 1.5 | 66 |
| A-21 | 0.16 | 1.72 | 2.2 | 27 |

The data show the loss in contrast and speed with the polyvinyl butyral resins. Dmin was also lower, and the cause is believed to be lower reactivity of the photothermographic chemistry when in contact with the pigmented polyvinyl butyral resin priming layer.

The stability of the white background of an image (dmin area) was then tested as indicated in Example One. The Hunter Lab L, a, and b values, and the composite stability indicator, ΔE, is given below. (ΔE is the square root of the sum of the squares of the delta L, delta a, and delta b values).

| Priming resin | Condition | L | a | b | ΔE |
|---|---|---|---|---|---|
| B-73 | initial + | 89.90 | 0.30 | 8.43 | |
| | two hours | 82.89 | 1.74 | 6.34 | |
| | delta | −7.01 | +1.44 | −2.09 | 7.46 |
| B-76 | initial + | 89.94 | 1.35 | 8.33 | |
| | two hours | 84.96 | 2.76 | 6.42 | |
| | delta | −4.98 | +1.41 | −1.91 | 5.52 |
| A-21 | initial + | 83.74 | 0.46 | 3.90 | |
| | two hours | 81.17 | 0.91 | 3.73 | |
| | delta | 2.57 | +0.45 | −0.17 | 2.61 |

This data show the greater stability to change with the acrylic resin priming layer. The acrylic prime exhibited lower initial yellowness (b value). It also gave a lower lightness value (initial L), which is consistent with its higher dmin value.

EXAMPLE 3

Titanium dioxide pigmented dispersions of methyl methacrylate (A-21 resin, Rohm & Haas), cellulose acetate (398-6, Eastman), and polyvinyl butyral resin (B-76, Monsanto) were coated onto a 76 μm thick white photographic grade paper base supplied by Simpson Paper Co. This prime layer was overcoated with a two layer blue green sensitive photothermographic layer.

Sensitometry was measured with a pulsed xenon flash sensitometer with a flash exposure of $10^{-6}$ seconds through a stepless density wedge with a $10^0$–$10^4$ attenuation range. The samples were processed for seven seconds at 132° C.

| Priming Resin | Sensitometry Dmin | Dmax | Gamma | Speed (ergs/cm² at 1.4 density) |
|---|---|---|---|---|
| A-21 | 0.10 | 1.61 | 1.59 | 58 |
| CA 398-6 | 0.10 | 1.60 | 1.45 | 62 |
| B-73 | 0.09 | 1.60 | 1.14 | 78 |

Whitness stability was run as indicated in Example 2. The results are shown below.

| Priming resin | Condition | L | a | b | ΔE |
|---|---|---|---|---|---|
| A-21 | initial + | 86.99 | −1.76 | 4.48 | |
| | two hours | 80.57 | 0.69 | 5.65 | |
| | delta | −6.42 | 2.45 | 1.17 | 6.97 |
| CA 398-6 | initial + | 87.89 | −1.75 | 4.37 | |
| | two hours | 80.98 | 0.68 | 5.12 | |
| | delta | −6.91 | 2.43 | 0.75 | 7.36 |
| B-73 | initial + | 86.23 | −1.27 | 5.42 | |
| | two hours | 72.44 | 1.99 | 8.23 | |
| | delta | −13.79 | 3.26 | 2.81 | 14.45 |

The data from the above tests indicate that cellulose acetate showed stability and sensitometry performance levels comparable to those of acrylic resin A-21. The cellulose acetate type resins were excellent film forming resins but were found to possess the disadvantage of inadequate adhesion to paper and film substrates when used as a priming layer resin.

EXAMPLE 4

Prime/antihalation coatings were prepared using various resins as binders. The method used was as follows:

The prime coats were coated onto 27 kg (60 pound) paper 0.5 to 0.08 g/m$^2$ (0.9 gm/sq. ft.) coating weight and dried in an oven. The silver dispersion were then coated onto the primed surface followed by a topcoat. The coated papers were then exposed at various wavelengths in a sensitormeter and processed through a hot roll developer to form an image. The imaged paper was evaluated by means of a computer densitometer or Hunter Lab Scan Spectrocolorimeter.

Preliminary evaluations used a 2-hour stability test (samples were aged in a light box at 1000 foot candles under a daylight fluorescent tube at 75% relative humidity at room temperature) with a Hunter spectrocolorimeter being used to measure changes in "L" whiteness before and after aging in the controlled light box. A large change in L was undesirable because it represents a loss in whiteness and brightness of the white areas of the photographic image. The data using green and red filters is given in Tables I and II below.

TABLE I

| Green sensitive photothermographic formulation | | | | |
|---|---|---|---|---|
| Resin | Chemical name | P/B* | wt % Solids | Δ L over 2 hours |
| A (comparative) | polyvinyl pyrolidone | 2/1 | 27.1 | −6.59 |
| B1 (comparative) | polyvinyl butyral | 2/1 | 27.1 | −5.05 |
| B2 (comparative) | polyvinyl butyral | 1/1 | 18.18 | −4.04 |
| C1 | methyl methacrylate | 2/1 | 27.1 | −2.56 |
| C2 | methyl methacrylate | 1/1 | 18.18 | −2.56 |
| B1 (comparative) | polyvinyl butyral | 2/1 | 27.1 | −4.38 |
| D | methyl methacrylate/ethyl acrylate copolymer | 2/1 | 27 | −1.66 |

*pigment/binder ratio

TABLE II

| Red sensitive photothermographic formulation | | | | |
|---|---|---|---|---|
| Resin | Chemical name | P/B* | wt % Solids | Δ L over 2 hours |
| E (comparative) | polyvinyl butyral | 2/1 | 27.1 | −5.2 |
| F | methyl methacrylate ethyl acrylate copolymer | 2/1 | 27.1 | −3.2 |
| G (comparative) | polyurethane | 1/2 | 59 | −3.52* |
| H (comparative) | ethyl cellulose | 1/1 | 27.1 | −10.78 |

*note: 1 month aging of G showed severe loss of speed and gamma

Relating the 2-hour stability test with Hunter lab values to 12-hour test** along with Dmin change, the following data were obtained. Twelve hours were related to approximately one week in an office environment.

** samples were aged in a light box at 1000 foot candles of fluorescent lighting (fluorescent tube?) at 75% humidity and at ambient temperatures for 12 hours.

| Red Sensitive | | | | |
|---|---|---|---|---|
| Resin | P/B | wt. % solids | Δ L 12 hour | Δ Dmin 12 hour |
| polyvinyl butyral (comparative) | 2/1 | 27.1 | 11.3 | 0.12 |
| methyl methacrylate/ethyl acrylate | 2/1 | 27.1 | 7.6 | 0.05 |

The data of Tables I and II show improved whiteness stability of the present invention compared with comparative constructions.

EXAMPLE 5

The prime/antihalations coatings prepared as in Example 1 (resins B1 and F as described in Example 4) were incorporated into photothermographic constructions as in Examples 1 and were subjected to aging tests as follows:

The data is shown in Tables III and IV below.

TABLE III

| Green Sensitive | | Aging Studies | | | | |
|---|---|---|---|---|---|---|
| Resin | Conditions | Dmin | Dmax | Speed ergs/cm$^2$ | Gamma angle | Time of sampling |
| polyvinyl butyral (comparative) | 21° C./50% R.H.[a] | 0.13 | 1.73 | 11.03 | 64.84 | initial |
| | | 0.08 | 1.68 | 29.5 | 54.35 | 109 days |
| methyl methacrylate/ethyl acrylate | 21° C./50% R.H. | 0.12 | 1.75 | 11.16 | 63.99 | initial |
| | | 0.09 | 1.70 | 14.70 | 61.81 | 109 days |

[a]R.H. = relative humidity

TABLE IV

| Red Sensitive | | | | | | |
|---|---|---|---|---|---|---|
| Resin | Conditions | Dmin | Dmax | Speed ergs/cm$^2$ | Gamma angle | Time of sampling |
| polyvinyl butyral (comparative) | 21° C./50% R.H. | 0.11 | 1.67 | 56.14 | 62.87 | initial |
| | | | | | | 4 months |
| methyl methacrylate/ethyl acrylate | | 0.08 | 1.66 | 58.03 | 62.50 | initial |
| | | 0.13 | 1.73 | 41.7 | 63.93 | 4 months |
| polyvinyl butyral (comparative) | 49° C./50% R.H | 0.09 | 1.70 | 46 | 63.37 | initial |
| | | 0.11 | 1.79 | 55.59 | 65.11 | 1 month |
| methyl | | 0.09 | 1.16 | not | 41.40 | initial |

TABLE IV-continued

| Red Sensitive | | | | | | |
|---|---|---|---|---|---|---|
| Resin | Conditions | Dmin | Dmax | Speed ergs/cm$^2$ | Gamma angle | Time of sampling |
| methacrylate/ | | | | readable | | 1 month |
| ethyl acrylate | | 0.12 | 1.75 | 42.13 | 63.15 | |
| | | 0.10 | 1.76 | 125.14 | 58.87 | |

The data of Tables III and IV show the improved shelf life stability of the green sensitive material of the instant invention at ambient conditions; and red sensitive materials of the instant invention showed improved shelf life aging at higher temperatures.

Various modifications and alterations of this invention will become apparent to those skilled in the art without departing from the scope and spirit of this invention, and it should be understood that this invention is not to be unduly limited to the illustrative embodiments set forth herein.

We claim:

1. A photothermographic recording article comprising in sequence:

(a) a substrate, (b) a prime coat which is also an antihalation layer consisting essentially of a pigmented acrylic polymer binder system wherein said pigment is selected from the group consisting of titanium dioxide, zinc oxide, barium sulfate, and calcium carbonate and, wherein the weight ratio of pigment to binder is in the range of 4:1 to 1:10, and (c) a photothermographic dispersion comprising a binder, a non-light sensitive silver source material, photographic silver halide in catalytic proximity to said silver source material, said article further comprising a reducing agent for silver ion and at least one development accelerator in at least one of the layers on the substrate.

2. The photothermographic recording article according to claim 1 wherein said binder of said prime coat/antihalation layer is a polyacrylate or methacrylate ester of ($C_1$ to $C_{20}$) alkyl alcohol, or a copolymer or combination thereof.

3. The photothermographic recording article according to claim 1 wherein said binder of said prime coat and antihalation layer is a polyacrylate or methacrylate ester of a lower ($C_1$ to $C_4$) alkyl alcohol, copolymer or combination thereof.

4. The photothermographic recording article according to claim 2 wherein said binder is copolymer of methyl methacrylate and ethyl acrylate.

5. The photothermographic recording article according to claim 2 wherein said binder is selected from the group consisting of methyl methacrylate polymer, methyl methacrylate/butyl methacrylate copolymer, and isobutyl methacrylate polymer.

6. The photothermographic recording article according to claim 1 wherein said pigment of said prime coat/antihalation layer is zinc oxide, barium sulfate, calcium carbonate, or titanium dioxide.

7. The photothermographic recording article according to claim 6 wherein said pigment is titanium dioxide.

8. The photothermographic recording article according to claim 1 wherein said ratio is in the range of 2:1 to 1:5.

9. The photothermographic recording article according to claim 1 wherein said substrate is glass, a transparent polymeric film, an opaque polymeric film, fabric, metal foil, or paper.

10. The photothermographic recording article according to claim 9 wherein said substrate is paper.

11. The photothermographic recording article according to claim 9 wherein said substrate is polyester film.

12. The article according to claim 1 further having a topcoat layer.

13. The photothermographic recording article according to claim 12 wherein said at least one development accelerator is present in said topcoat layer.

14. A photothermographic recording article comprising in sequence:

(a) a substrate, (b) a prime coat which is also an antihalation layer consisting essentially of a titanium dioxide pigmented acrylic polymer binder system wherein the weight ratio of pigment to binder is in the range of 4:1 to 1:10, (c) a photothermographic dispersion comprising a binder, a non-light sensitive silver source material, photographic silver halide in catalytic proximity to said silver source material, said article further comprising a reducing agent for silver ion and at least one development accelerator in at least one of the layers on the substrate.

15. The article according to claim 14 further having a topcoat layer.

16. A photothermographic recording article comprising in sequence:

(a) a paper substrate, (b) a prime coat which is also an antihalation layer consisting essentially of a titanium dioxide pigmented acrylic polymer binder system wherein the ratio of pigment to binder is in the range of 4:1 to 1:10, (c) a photothermographic dispersion comprising a binder, a non-light sensitive silver source material, photographic silver halide in catalytic proximity to said silver source material, said article further comprising a reducing agent for silver ion and at least one development accelerator in at least one of the layers on the substrate.

17. The article according to claim 16 further having a topcoat layer.

* * * * *